US005747415A

United States Patent [19]

Campbell et al.

[11] Patent Number: 5,747,415

[45] Date of Patent: May 5, 1998

[54] SUBBING LAYER FOR ANTISTATIC LAYER ON DYE-RECEIVING ELEMENT USED IN THERMAL DYE TRANSFER

[75] Inventors: Bruce Crinean Campbell; Thomas William Martin, both of Rochester; Ronald Stewart King; David Randall Williams, both of Fairport, all of N.Y.; Frederick W. Hesser, Marietta, Pa.

[73] Assignees: Eastman Kodak Company, Rochester, N.Y.; Mobil Oil Corporation, Fairfax, Va.

[21] Appl. No.: 663,960

[22] Filed: Jun. 14, 1996

[51] Int. Cl.[6] ..... B41M 5/035; B41M 5/38

[52] U.S. Cl. ..... 503/227; 428/195; 428/304.4; 428/910; 428/913; 428/914

[58] Field of Search ..... 8/471; 428/195, 428/304.4, 341, 913, 914, 910; 503/227

[56] References Cited

U.S. PATENT DOCUMENTS

| | | | |
|---|---|---|---|
| 5,198,408 | 3/1993 | Martin | 503/227 |
| 5,244,861 | 9/1993 | Campbell et al. | 503/227 |

OTHER PUBLICATIONS

U. S. Application Ser. No. 08/664,334 filed Jun. 14, 1996, Dye–Receiving Element For Thermal Dye Transfer, Campbell.

U.S. Application Ser. No. 08/591,753, filed Jan. 25, 1996, Backing Layer For Receiver Used In Thermal Dye Transfer, Martin et al.

*Primary Examiner*—Bruce H. Hess

*Attorney, Agent, or Firm*—Harold E. Cole

[57] ABSTRACT

A dye-receiving element for thermal dye transfer comprising a support having on the front side thereof, in order, a biaxially-oriented composite film laminated thereto and a dye image-receiving layer, the composite film comprising a microvoided thermoplastic core layer and at least one substantially void-free thermoplastic surface layer, the support having on the back side thereof, in order, a biaxially-oriented film laminated thereto, a subbing layer and an antistatic layer, the subbing layer comprising an acrylic monomer, an acrylic homopolymer, an acrylic copolymer, a mixture of polyethylenes and a copolymer or terpolymer of polypropylene, or polypropylene having at least 0.1 g/m$^2$ of titanium dioxide, the ratio of thickness of the back side film to the composite film being from about 0.45 to about 1.0.

20 Claims, No Drawings

SUBBING LAYER FOR ANTISTATIC LAYER ON DYE-RECEIVING ELEMENT USED IN THERMAL DYE TRANSFER

This invention relates to dye-receiving elements used in thermal dye transfer processes, and more particularly to dye-receiving elements containing microvoided composite films and having a subbing layer for an antistatic layer.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye-receiving elements used in thermal dye transfer generally comprise a polymeric dye image-receiving layer coated on a base or support and an antistatic backing layer on the opposite side. Transport through the thermal printer is very dependent on the base properties. For acceptable performance, the dye-receiving element must have low curl under a wide variety of environmental conditions, conditions at which the printer will be operating. From an aesthetics standpoint, it is also desirable for the dye-receiving element to exhibit low curl under the wide variety of environmental conditions at which the print will be displayed or kept.

U.S. Pat. No. 5,244,861 describes a dye-receiving element for thermal dye transfer comprising a base having thereon a dye image-receiving layer, wherein the base comprises a composite film laminated to a cellulosic paper support, the dye image-receiving layer being on the composite film side of the base, and the composite film comprising a microvoided thermoplastic core layer having a stratum of voids therein and at least one substantially void-free thermoplastic surface (skin) layer. This dye-receiving element exhibits low curl and excellent printer performance at typical ambient conditions. There is a problem with this receiver under extreme environmental humidity conditions, however, when significant curl can be observed.

U.S. Pat. No. 5,612,283, relates to a receiving element comprising a support having on the front side thereof, a biaxially-oriented composite film laminated thereto and a dye image-receiving layer, the composite film comprising a microvoided thermoplastic core layer and at least one substantially void-free thermoplastic surface layer, the support having on the back side thereof a biaxially-oriented transparent film laminated thereto. Due to this balanced structure, the dye-receiving element exhibits low curl and excellent printer performance at a wide range of environmental humidity conditions.

An antistatic backing layer for a thermal dye transfer print is chosen to (1) provide adequate friction to a thermal printer rubber picker roller to allow removal of one receiver element at a time from a thermal printer receiver element supply stack, (2) minimize interactions between the front and back surfaces of receiving elements such as dye retransfer from one imaged receiving element to the antistatic backing layer of an adjacent receiving element in a stack of imaged receiving elements, (3) minimize sticking between a dye-donor element and the receiving element antistatic backing layer when the receiving element is accidentally inserted into a thermal printer wrong-side up, and (4) provide sufficient surface conductivity to dissipate static charges that can build up during transport of the elements through a thermal printer.

An antistatic backing layer that has these properties is described in U.S. Pat. No. 5,198,408 and co-pending U.S. application Ser. No. 08/591,753, the disclosures of which are hereby incorporated by reference. An infrared-absorbing dye may also be incorporated into such an antistatic backing layer for use of the dye-receiving element in printers equipped with suitable media recognition sensors. However, there is a problem with these antistatic backing layers in that they do not have acceptable adhesion to an oriented polypropylene packaging film on the back side of a dye-receiving element which is needed to control humidity curl. If the antistatic backing layer comes off during the printing operation, it would cause dirt and transport problems in the printer.

It is an object of this invention to provide a microvoided receiver is for thermal dye transfer printing which has improved curl resistance under extreme environmental humidity conditions. It is a further object of the invention to provide a microvoided receiver for thermal dye transfer which has good adhesion to an antistatic backing layer.

These and other objects are accomplished in accordance with the invention, which relates to a dye-receiving element for thermal dye transfer comprising a support having on the front side thereof, in order, a biaxially-oriented composite film laminated thereto and a dye image-receiving layer, the composite film comprising a microvoided thermoplastic core layer and at least one substantially void-free thermoplastic surface layer, the support having on the back side thereof, in order, a biaxially-oriented film laminated thereto, a subbing layer and an antistatic layer, the subbing layer comprising an acrylic monomer, an acrylic homopolymer, an acrylic copolymer, a mixture of polyethylenes and a copolymer or terpolymer of polypropylene, such as ethylene-propylene copolymer or ethylene-propylene-butylene terpolymer, or polypropylene having at least 0.1 $g/m^2$ of titanium dioxide, the ratio of thickness of the back side film to the composite film being from about 0.45 to about 1.0.

The support used in the invention can be, for example, a polymeric, a synthetic paper, or a cellulose fiber paper support, such as a water leaf sheet of wood pulp fibers or alpha pulp fibers, etc.

The film laminated to the back side of the support in the invention can be, for example, biaxially-oriented polyesters, biaxially-oriented polyolefin films such as polyethylene, polypropylene, polymethylpentene, and mixtures thereof. Polyolefin copolymers, including copolymers of ethylene and propylene are also useful. In a preferred embodiment, polypropylene is preferred. The thickness of the film can be from about 12 to about 75 μm. The transparent film usually has a light transmission of at least 70%, i.e., at least 70% of visible light is transmitted by this film. In a preferred embodiment of the invention, the film laminated to the back side of the element can be a composite film like the one laminated to the front side.

The film can be laminated to the support using a tie layer such as a polyolefin such as polyethylene, polypropylene, etc., if desired.

As noted above, the subbing layer which is coated on top of the film laminated to the back side of the support can be a homopolymer and/or co-polymer of an acrylic monomer, such as acrylic acid, methacrylic acid and/or any of their esters. Copolymers of these acrylic monomers may also contain a small amount of a vinyl monomer such as styrene. Examples of other useful materials are found in U.S. Pat. Nos. 3,753,769; 4,058,645; and 4,439,493, the disclosures of which are hereby incorporated by reference. Various additives can also be added to the subbing layer such as titanium dioxide, fillers such as calcium carbonate, clays, etc., in an amount of from about 0.1 g/m$^2$ to about 2.0 g/m$^2$. The subbing layer may be applied at a coverage of from about 0.1 g/m$^2$ to about 2.0 g/m$^2$.

The antistatic layer employed in the invention can comprise materials commonly used in such a layer as disclosed in the U.S. Pat. No. 5,198,408 and co-pending U.S. Ser. No. 08/591,753, referred to above. In general, an antistatic layer comprises a polymeric binder, submicron colloidal inorganic particles and an ionic antistatic agent.

Examples of a polymeric binder which can be employed in the antistatic backing layer of the invention include poly(ethylene oxide), poly(ethylene glycol), poly(vinyl alcohol) (PVA), etc. Preferably, the total amount of polymeric binder comprises from about 10 to about 80 wt. % of the antistatic backing layer, with at least about one-half, preferably at least about two-thirds, of the polymeric binder by weight being PVA.

The submicron colloidal inorganic particles employed in the antistatic backing layer employed in the invention preferably comprise from about 15 to about 80 wt. % of the backing layer mixture. While any submicron colloidal inorganic particles may be used, the particles preferably are water dispersible and less than 0.1 μm in size, and more preferably from about 0.01 to 0.05 μm in size. There may be used in the layer, for example, silica, alumina, titanium dioxide, barium sulfate, etc. In a preferred embodiment, silica particles are used.

Ionic antistatic agents useful in the antistatic backing layer employed in the invention include materials such as alkali metal salts, vanadium pentoxide, or others known in the art. In a preferred embodiment, alkali metal salts are employed such as potassium acetate, sodium acetate, potassium chloride, sodium chloride, potassium nitrate, sodium nitrate, lithium nitrate, potassium formate, sodium formate, etc. These salts may be employed at a coverage of from about 0.02 to about 0.05 g/m$^2$, preferably about 0.03 to about 0.04 g/m$^2$.

Due to their relatively low cost and good appearance, composite films are generally used and referred to in the trade as "packaging films." The low specific gravity of microvoided packaging films (preferably between 0.3–0.7 g/cm$^3$) produces dye-receivers that are very conformable and results in low mottle-index values of thermal prints. These microvoided packaging films also are very insulating and produce dye-receiver prints of high dye density at low energy levels. The nonvoided skin produces receivers of high gloss and helps to promote good contact between the dye-receiving layer and the dye-donor film. This also enhances print uniformity and efficient dye transfer.

Microvoided composite packaging films are conveniently manufactured by coextrusion of the core and surface layers, with subsequent biaxial orientation, whereby voids are formed around void-initiating material contained in the core layer. Such composite films are disclosed in, for example, U.S. Pat. No. 4,377,616, the disclosure of which is incorporated by reference.

The core of the composite film should be from 15 to 95% of the total thickness of the film, preferably from 30 to 85% of the total thickness. The nonvoided skin(s) should thus be from 5 to 85% of the film, preferably from 15 to 70% of the thickness. The density (specific gravity) of the composite film should be between 0.2 and 1.0 g/cm$^3$, preferably between 0.3 and 0.7 g/cm$^3$. As the core thickness becomes less than 30% or as the specific gravity is increased above 0.7 g/cm$^3$, the composite film starts to lose useful compressibility and thermal insulating properties. As the core thickness is increased above 85% or as the specific gravity becomes less than 0.3 g/cm$^3$, the composite film becomes less manufacturable due to a drop in tensile strength and it becomes more susceptible to physical damage. The total thickness of the composite film can range from 20 to 150 μm, preferably from about 30 to about 70 μm. Below 30 μm, the microvoided films may not be thick enough to minimize any inherent non-planarity in the support and would be more difficult to manufacture. At thicknesses higher than 70 μm, little improvement in either print uniformity or thermal efficiency are seen, and so there is little justification for the further increase in cost for extra materials.

Suitable classes of thermoplastic polymers for the core matrix-polymer of the composite film include polyolefins, polyesters, polyamides, polycarbonates, cellulosic esters, polystyrene, polyvinyl resins, polysulfonamides, polyethers, polyimides, poly(vinylidene fluoride), polyurethanes, poly (phenylene sulfides), polytetrafluoroethylene, polyacetals, polysulfonates, polyester ionomers, and polyolefin ionomers. Copolymers and/or mixtures of these polymers can be used. Suitable polyolefins for the core matrix-polymer of the composite film include polypropylene, polyethylene, polymethylpentene, and mixtures thereof. Polyolefin copolymers, including copolymers of ethylene and propylene are also useful.

Suitable polyesters for the core matrix-polymer of the composite film include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalenedicarboxylic acids, succinic, glutaric, adipic, azelaic, sebacic, fumaric, maleic, itaconic, 1,4-cyclohexanedicarboxylic, sodiosulfoisophthalic acids and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well known techniques, e.g., those described in U.S. Pat. Nos. 2,465,319 and 2,901,466.Preferred continuous matrix polyesters are those having repeat units from terephthalic acid or naphthalenedicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amounts of a co-acid component such as stilbenedicarboxylic acid. Examples of such liquid crystal copolyesters are those disclosed in U.S. Pat. Nos. 4,420,607, 4,459,402 and 4,468,510.

Useful polyamides for the core matrix-polymer of the composite film include Nylon 6, Nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite films include cellulose nitrate, cellulose triacetate, cellulose diacetate, cellulose acetate propionate, cellulose acetate butyrate, and mixtures or copolymers thereof. Useful polyvinyl resins include poly(vinyl chloride), poly(vinyl acetal), and mixtures thereof. Copolymers of vinyl resins can also be utilized.

The nonvoided skin layers of the composite film can be made of the same polymeric materials as listed above for the core matrix. The composite film can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix and/or to the skins to improve the whiteness of these films. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the film or the manufacturability of the film.

The coextrusion, quenching, orienting, and heat setting of these composite films may be effected by any process which is known in the art for producing oriented film, such as by a flat film process or a bubble or tubular process. The flat film process involves extruding the blend through a slit die and rapidly quenching the extruded web upon a chilled casting drum so that the core matrix polymer component of the film and the skin components(s) are quenched below their glass transition temperatures (Tg). The quenched film is then biaxially oriented by stretching in mutually perpendicular directions at a temperature above the glass transition temperature of the matrix and skin polymers. The film may be stretched in one direction and then in a second direction or may be simultaneously stretched in both directions. After the film has been stretched it is heat-set by heating to a temperature sufficient to crystallize the polymers while restraining to some degree the film against retraction in both directions of stretching.

These composite films may be coated or treated, after the coextrusion and orienting processes or between casting and full orientation, with any number of coatings which may be used to improve the properties of the films including printability, to provide a vapor barrier, to make them heat sealable, or to improve adhesion to the support or to the receiver layers. Examples of this would be acrylic coatings for printability, coating poly(vinylidene chloride) for heat seal properties, or corona discharge treatment to improve printability or adhesion.

By having at least one nonvoided skin on the microvoided core, the tensile strength of the film is increased and makes it more manufacturable. It allows the films to be made at wider widths and higher draw ratios than when films are made with all layers voided. Coextruding the layers further simplifies the manufacturing process.

It is preferable to extrusion laminate the microvoided composite films using a polyolefin resin onto the paper support. During the lamination process, it is desirable to maintain minimal tension of the microvoided packaging film in order to minimize curl in the resulting laminated receiver support.

In one preferred embodiment, in order to produce receiver elements with a desirable photographic look and feel, it is preferable to use relatively thick paper supports (e.g., at least 120 μm thick, preferably from 120 to 250 μm thick) and relatively thin microvoided composite packaging films (e.g., less than 50 μm thick, preferably from 20 to 50 μm thick, more preferably from 30 to 50 μm thick).

The dye image-receiving layer of the receiving elements of the invention may comprise, for example, a polycarbonate, a polyurethane, a polyester, poly(vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 10 $g/m^2$. An overcoat layer may be further coated over the dye-receiving layer, such as described in U.S. Pat. No. 4,775,657, the disclosure of which is incorporated by reference.

Dye-donor elements that are used with the dye-receiving element of the invention conventionally comprise a support having thereon a dye-containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228, the disclosures of which are incorporated by reference.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with s sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to further illustrate the invention.

EXAMPLE

A. Paper Support Stock

A 1:1 blend of Pontiac Maple 51 (a bleached maple hardwood kraft of 0.5 μm length weighted average fiber length) available from Consolidated Pontiac, Inc., and Alpha Hardwood Sulfite (a bleached red-alder hardwood sulfite of 0.69 μm average fiber length), available from Weyerhauser Paper Co., 137 μm thick, was used in all examples except Invention Examples 1 and 2. The paper stock used for Invention Examples 1 and 2 was 157 μm thick and made from a 100% hardwood Kraft pulp blend.

The films shown in Table 1 were laminated to the opposite or back side of the paper stock. The films all contained on the film surface a subbing layer as shown in Table 1. The materials for the subbing layer of Controls 1 and 3 are further described in U.S. Pat. Nos. 4,214,039; 4,447,494; and 4,794,136.

All examples were coated with an antistatic layer having a total dry coverage ranging from 0.6 to 2.0 g/m$^2$. All examples, except for Invention 2 and Control 6, were coated with the following antistatic layer as described in Example 6 in co-pending U.S. Ser. No. 08/591,753 as follows:

| | |
|---|---|
| Polyvinyl alcohol | 0.23 |
| Silica | 0.45 |
| Glucopon 225 ® surfactant | 0.01 |
| potassium acetate | 0.03 |
| poly(acrylic acid) | 0.03 |
| Tyzor TE ® (titanium tetraethoxide) | 0.02 |

Invention 2 and Control 6 examples were coated with an antistatic backing layer as described in Example 6 in U.S. Pat. No. 5,198,408 as follows:

| | |
|---|---|
| Polyvinyl alcohol | 0.14 |
| Silica | 0.47 |
| Daxad ® 30 surfactant | 0.04 |
| Polyox WSRN-10 polyethylene oxide | 0.14 |
| Polystyrene beads | 0.22 |
| Triton X200E ® surfactant | 0.02 |

TABLE 1

| Example | Back side Film* | Back Side Film Thickness (μm) | Subbing Layer | Antistatic Layer Example 6 of |
|---|---|---|---|---|
| Invention 1 | BICOR ® 70 MLT | 18 | mixture of polyethylenes and a terpolymer of ethylene-propylene-butylene | U.S.S.N. 08/591,753 |
| Invention 2 | BICOR ® 70 MLT | 18 | mixture of polyethylenes and a terpolymer of ethylene-propylene-butylene | U.S.P. 5,198,408 |
| Invention 3 | BICOR ® 318 ASB | 22 | acrylic acid, methyl acrylate, and ethyl acrylate containing layer | U.S.S.N. 08/591,753 |
| Invention 4 | OPPalyte ® 350 TWK | 37 | oriented polypropylene layer containing 0.17 g/m$^2$ of $TiO_2$ | U.S.S.N. 08/591,753 |
| Invention 5 | OPPalyte ® 350 K18 | 37 | oriented polypropylene layer containing 1.10 g/m$^2$ of $TiO_2$ | U.S.S.N. 08/591,753 |
| Control 1 | BICOR ® 318 ASB | 22 | poly(vinylidene chloride) containing layer | U.S.S.N. 08/591,753 |
| Control 2 | BICOR ® LBW 100 | 25 | oriented high density polyethylene layer with 54 dyne/cm surface charge | U.S.S.N. 08/591,753 |
| Control 3 | OPPalyte ® 370 HSW | 28 | poly(vinylidene chloride) containing layer | U.S.S.N. 08/591,753 |
| Control 4 | 240 LLG 101 | 32 | oriented polypropylene layer with 38 dyne/cm surface charge | U.S.S.N. 08/591,753 |
| Control 5 | None | | extruded high-density polyethylene | U.S.S.N. 08/591,753 |
| Control 6 | None | | extruded high-density polyethylene | U.S.P. 5,198,408 |
| Control 7 | PROCOR ® 60 PAC | 15 | acrylic acid methyl acrylate ethyl acrylate containing layer | U.S.S.N. 08/591,753 |

*all back side films were polypropylene (Mobil Chemical Co.) and are described in a brochure entitled "Mobil Flexible Packing Films Product Characteristics" (September 1995).

B. Preparation of the Microvoided Support

Receiver support examples were prepared in the following manner.

A commercially available packaging film (OPPalyte® 350 K18 made by Mobil Chemical Co.) was laminated to the front side of the paper stocks described above. OPPalyte® 350 K18 is a composite film (37 μm thick) (d=0.62) consisting of a microvoided and oriented polypropylene core (approximately 73% of the total film thickness), with a titanium dioxide pigmented non-microvoided oriented polypropylene layer on each side; the void-initiating material is poly(butylene terephthalate). Reference is made to U.S. Pat. No. 5,244,861 where details for the production of this laminate are described.

Packaging films may be laminated in a variety of ways (by extrusion, pressure, or other means) to a paper support. In the present example, the polymer films were extrusion laminated as described below with pigmented polyolefin onto the front side of the paper stock support. The pigmented polyolefin was polyethylene (12 g/m$^2$) containing anatase titanium dioxide (12.5% by weight) and a benzoxazole optical brightener (0.05% by weight). The back side films were also extrusion laminated to the opposite side of the paper stock support with clear high density polyethylene (12 g/m$^2$).

Controls 5 and 6 were prepared in a similar manner as described above except that no film was applied to the back side of the paper stock support. In these examples, the back side was extrusion coated with high density polyethylene (30 g/m$^2$).

C. Preparation of Thermal Dye Transfer Receiving Elements

Thermal dye-transfer receiving elements were prepared from the above Invention examples 3–5 and Controls 2, 3, 6 and 7 by coating the following layers in order on the top surface of the microvoided packaging film:

a) a subbing layer of Prosil® 221 and Prosil® 2210 (PCR, Inc.) (1:1 weight ratio) both are amino-functional organo-oxysilanes, in an ethanol-methanol-water solvent mixture. The resultant solution (0.10 g/m$^2$) contained approximately 1% of silane component, 1% water, and 98% of 3A alcohol;

b) a dye-receiving layer containing Makrolon® KL3-1013 (a polyether-modified bisphenol-A polycarbonate block copolymer) (Bayer AG) (1.82 g/m$^2$), GE Lexan® 141-112 (a bisphenol-A polycarbonate) (General Electric Co.) (1.49 g/m$^2$), and Fluorad® FC-431 (perfluorinated alkylsulfonamidoalkyl ester surfactant) (3M Co.) (0.011 g/m$^2$), di-n-butyl phthalate (0.33 g/m$^2$), and diphenyl phthalate (0.33 g/m$^2$) and coated from a solvent mixture of methylene chloride and trichloroethylene (4:1 by weight) (4.1% solids);

c) a dye-receiver overcoat containing a solvent mixture of methylene chloride and trichloroethylene; a polycarbonate random terpolymer of bisphenol-A (50 mole %), diethylene glycol (93.5 wt %) and polydimethylsiloxane (6.5 wt. %) 2500 MW) block units (50% mole %) (0.65 g/m$^2$) and surfactants DC-510 Silicone Fluid (Dow-Corning Corp.) (0.008 g/m$^2$), and Fluorad® FC-431 (3M Co.) (0.016 g/m$^2$) from dichloromethane.

Invention examples 1 and 2 were coated with the layers described above except that layer (b) was:

a dye-receiving layer containing Makrolon® KL3-1013 (a polyether-modified bisphenol-A polycarbonate block copolymer) (Bayer AG) (1.71 g/m$^2$), GE Lexan® 141-112 (a bisphenol-A polycarbonate) (General Electric Co.) (1.40 g/m$^2$), Drapex® 429 (a 1,3-butylene glycol adipate) (Witco Corp.) (0.26 g/m$^2$) and Fluorad® FC-431 (perfluorinated alkyl sulfonamidoalkyl ester surfactant) (3M Co.) (0.011 g/m$^2$), and diphenyl phthalate (0.52 g/m$^2$) and coated from a solvent mixture of methylene chloride and trichloroethylene (4:1 by weight) (4.1% solids).

Control examples 1,4 and 5 had no front side coatings.

D. Curl Measurements on Test Examples

Test examples were conditioned for one week at both 5% RH/23° C. and 85% RH/23° C., after which curl measurements were made. The test examples were 21.6 cm×27.9 cm in size (27.9 cm in the machine direction).

After conditioning, the examples were placed on a flat surface with the curled edges pointing away from the flat surface. Using a ruler, the height (measured to the nearest 0.16 cm) of each corner above the flat surface was measured. The four heights were averaged together to give a single edge rise curl value. A positive curl value indicates curl toward the face or dye-receiving layer side. A negative curl value indicates curl toward the back side. For comparison purposes, the curl difference between 85% RH(23° C. and 5% RH/23° C. is given to represent total curl performance (smaller differences mean lower curl over this range). This curl method is based on TAPPI Test Method T 520 cm-85. Curl difference values of 15 mm or less are considered good for humidity curl. The results are shown in Table 2.

E) Antistatic Backing Layer Adhesion Test

Test examples, 21.6 cm×27.9 cm in size, were placed on a flat surface with the antistatic backing layer side facing up. A 2 kg brass block, with black carborundum paper wrapped around it, was the placed on one corner of the test example (black carborundum paper contacting the antistatic backing layer). The block was slid diagonally to the opposite corner and then back to the starting corner. This procedure was repeated 10 times along the same path. No additional force was applied to the brass weight during the rubbing process.

The test examples were then run through a Kodak Ektamatic Processor containing a green dye solution (0.1% Malachite green dye and 99.% water) and allowed to dry. The green dye has an attraction to an antistatic layer. Therefore, in areas where the top layer of antistatic material has been removed, the green dye solution will not dye the layer. In areas where the antistatic layer is present, the green dye solution will dye the layer. The rubbed areas of the examples were rated as follows:

Adhesion test ratings

1=no antistatic layer removed, example totally dyed

2=some antistatic layer removed, some non-dyed areas

3=moderate to heavy antistatic layer removal, ½ to ¾ of dye removed

4=total antistatic layer removal, all of the dye is removed

A rating of 1 or 2 is considered acceptable adhesion. A rating of 3 or 4 is unacceptable. The adhesion testing results are also shown in Table 2.

TABLE 2

| Example | Back Side/ Front Side Film Thickness Ratio* | Adhesion Rating | Edge Rise Curl At 5% RH, 23° C. (mm) | Edge Rise Curl At 85% RH, 23° C. (mm) | Curl Difference 85%–5% RH (mm) |
|---|---|---|---|---|---|
| Invention 1 | 0.49 | 1 | 6.4 | 8.6 | 2.2 |
| Invention 2 | 0.49 | 2 | 5.3 | 7.9 | 2.6 |
| Invention 3 | 0.59 | 1 | −7.6 | −6.9 | 0.7 |
| Invention 4 | 1.00 | 1 | −10.7 | −9.9 | 0.8 |
| Invention 5 | 1.00 | 1 | −10.7 | −7.1 | 3.6 |
| Control 1 | 0.59 | 4 | −9.1 | −6.6 | 2.5 |
| Control 2 | 0.68 | 4 | −12.2 | −20.6 | −8.4 |
| Control 3 | 0.76 | 4 | −5.8 | −6.1 | −0.3 |
| Control 4 | 0.86 | 4 | −5.1 | −20.6 | −15.5 |
| Control 5 | — | 1 | −67.3 | 21.3 | −88.6 |
| Control 6 | — | 1 | −69.3 | 10.4 | −79.7 |
| Control 7 | 0.41 | 1 | −7.6 | 13.0 | −20.6 |

*Back side film thicknesses of Table 1 divided by 37

The above data show the humidity curl advantage of thermal dye transfer receiving elements according to the invention (Inventions 1–5) with polypropylene films on both sides of a paper support core, when compared with receiving elements with a polypropylene film on only one side of a paper support core (Control 5 and Control 6). The data also show the humidity curl control advantage of thermal dye transfer receiving elements according to the invention (Inventions 1–5) with polypropylene films on both sides of a paper support core, when compared with a receiving element having a back side/front side film thickness ratio less than 0.45 (Control 7).

Although Controls 1–4 which did not have the subbing layer of the invention have good curl control, they had poor adhesion. Only the examples of the invention had both good adhesion and humidity curl control.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on the front side thereof, in order, a biaxially-oriented composite film laminated thereto and a dye image-receiving layer, said composite film comprising a microvoided thermoplastic core layer and at least one substantially void-free thermoplastic surface layer, said support having on the back side thereof, in order, a biaxially-oriented film laminated thereto, a subbing layer and an antistatic layer, said subbing layer comprising an acrylic monomer, an acrylic homopolymer, an acrylic copolymer, a mixture of polyethylenes and a copolymer or terpolymer of polypropylene, or polypropylene having at least 0.1 g/m$^2$ of titanium dioxide, the ratio of thickness of the back side film to the composite film being from about 0.45 to about 1.0.

2. The element of claim 1 wherein said composite film and said back side film are each polypropylene.

3. The element of claim 1 wherein the thickness of said composite film is from about 30 to about 70 μm.

4. The element of claim 1 wherein said microvoided thermoplastic core layer has a substantially void-free thermoplastic surface layer on each side thereof.

5. The element of claim 1 wherein said microvoided thermoplastic core layer comprises oriented polypropylene having on each side thereof a substantially void-free thermoplastic surface layer of oriented polypropylene.

6. The element of claim 1 wherein said back side film is a composite film comprising a microvoided thermoplastic core layer and at least one substantially void-free thermoplastic surface layer.

7. The element of claim 1 wherein said subbing layer comprises a mixture of polyethylenes and a copolymer or terpolymer of polypropylene.

8. A process of forming a dye transfer image comprising:

a) imagewise-heating a dye-donor element comprising a support having thereon a dye layer comprising a dye dispersed in a binder, and b) transferring a dye image to a dye-receiving element to form said dye transfer image, wherein said dye-receiving element comprises a support having on the front side thereof, in order, a biaxially-oriented composite film laminated thereto and a dye image-receiving layer, said composite film comprising a microvoided thermoplastic core layer and at least one substantially void-free thermoplastic surface layer, said support having on the back side thereof, in order, a biaxially-oriented film laminated thereto, a subbing layer and an antistatic layer, said subbing layer comprising an acrylic monomer, an acrylic homopolymer, an acrylic copolymer, a mixture of polyethylenes and a copolymer or terpolymer of polypropylene, or polypropylene having at least 0.1 g/m$^2$ of titanium dioxide, the ratio of thickness of the back side film to the composite film being from about 0.45 to about 1.0.

9. The process of claim 8 wherein said composite film and said back side film are each polypropylene.

10. The process of claim 8 wherein the thickness of said composite film is from about 30 to about 70 μm.

11. The process of claim 8 wherein said microvoided thermoplastic core layer has a substantially void-free thermoplastic surface layer on each side thereof.

12. The process of claim 8 wherein said microvoided thermoplastic core layer comprises oriented polypropylene having on each side thereof a substantially void-free thermoplastic surface layer of oriented polypropylene.

13. The process of claim 8 wherein said back side film is a composite film comprising a microvoided thermoplastic core layer and at least one substantially void-free thermoplastic surface layer.

14. The process of claim 8 wherein said subbing layer comprises a mixture of polyethylenes and a copolymer or terpolymer of polypropylene.

15. A thermal dye transfer assemblage comprising:

a) a dye-donor element comprising a support having thereon a dye layer comprising a dye dispersed in a binder, and b) a dye-receiving element comprising a support having thereon a dye image-receiving layer, said dye-receiving element being in a superposed relationship with said dye-donor element so that said dye layer is in contact with said dye image-receiving layer, wherein said dye-receiving element comprises said support having on the front side thereof, in order, a biaxially-oriented composite film laminated thereto and said dye image-receiving layer, said composite film comprising a microvoided thermoplastic core layer and at least one substantially void-free thermoplastic surface layer, said support having on the back side thereof, in order, a biaxially-oriented film laminated thereto, a subbing layer and an antistatic layer, said subbing layer comprising an acrylic monomer, an acrylic homopolymer, an acrylic copolymer, a mixture of polyethylenes and a copolymer or terpolymer of polypropylene, or polypropylene having at least 0.1 g/m$^2$ of titanium dioxide, the ratio of thickness of the back side film to the composite film being from about 0.45 to about 1.0.

16. The assemblage of claim 15 wherein said composite film and said back side film are each polypropylene.

17. The assemblage of claim 15 wherein the thickness of said composite film is from about 30 to about 70 μm.

18. The assemblage of claim 15 wherein said microvoided thermoplastic core layer has a substantially void-free thermoplastic surface layer on each side thereof.

19. The assemblage of claim 15 wherein said microvoided thermoplastic core layer comprises oriented polypropylene having on each side thereof a substantially void-free thermoplastic surface layer of oriented polypropylene.

20. The assemblage of claim 15 wherein said subbing layer comprises a mixture of polyethylenes and a copolymer or terpolymer of polypropylene.

* * * * *